US006138752A

United States Patent [19]

Bass et al.

[11] Patent Number: 6,138,752

[45] Date of Patent: Oct. 31, 2000

[54] METHOD AND APPARATUS TO DETERMINE SUBTERRRANEAN FORMATION STRESS

[75] Inventors: Ronald Marshall Bass, Houston; Arthur William Galloway, II, Missouri City, both of Tex.

[73] Assignee: Shell Oil Company, Houston, Tex.

[21] Appl. No.: 09/096,076

[22] Filed: Jun. 11, 1998

Related U.S. Application Data

[60] Provisional application No. 60/049,292, Jun. 11, 1997.

[51] Int. Cl.[7] ..... E21B 47/06

[52] U.S. Cl. ..... 166/250.01; 166/66; 173/152.59; 173/152.17; 173/152.01; 173/784

[58] Field of Search ..... 73/152.17, 152.59, 73/784, 152.01; 166/250.01, 250.07, 66, 113

[56] References Cited

U.S. PATENT DOCUMENTS

| | | | |
|---|---|---|---|
| 4,149,409 | 4/1979 | Serata | 73/784 |
| 4,733,567 | 3/1988 | Serata | 73/784 |
| 4,899,320 | 2/1990 | Hearn et al. | 367/35 |
| 5,050,690 | 9/1991 | Smith | 175/50 |
| 5,540,101 | 7/1996 | Capelle et al. | 73/784 |

*Primary Examiner*—Eileen Dunn Lillis
*Assistant Examiner*—John Kreck
*Attorney, Agent, or Firm*—Del S. Christensen

[57] ABSTRACT

The invention is a method to determine stress within a formation, the method comprising the steps of: providing a closed reference pressure volume within the formation; providing a flexible diaphragm which can be exposed on one side to formation, and on the other side to the closed reference pressure volume; providing a switch wherein the switch generates a signal based on the diaphragm being in a position indicative of the diaphragm being flexed by pressure on one side of the diaphragm being greater than pressure on the other side of the diaphragm; cycling a pressure within the reference pressure volume to between a pressure at which a signal is generated and a pressure at which a signal is not generated; and determining the formation stress as the pressure at which the signal changes. Another aspect of the invention is the apparatus useful in this method. The switch is preferably an electrical contact that is activated by movement of the diaphragm.

11 Claims, 3 Drawing Sheets

FIG. 2A
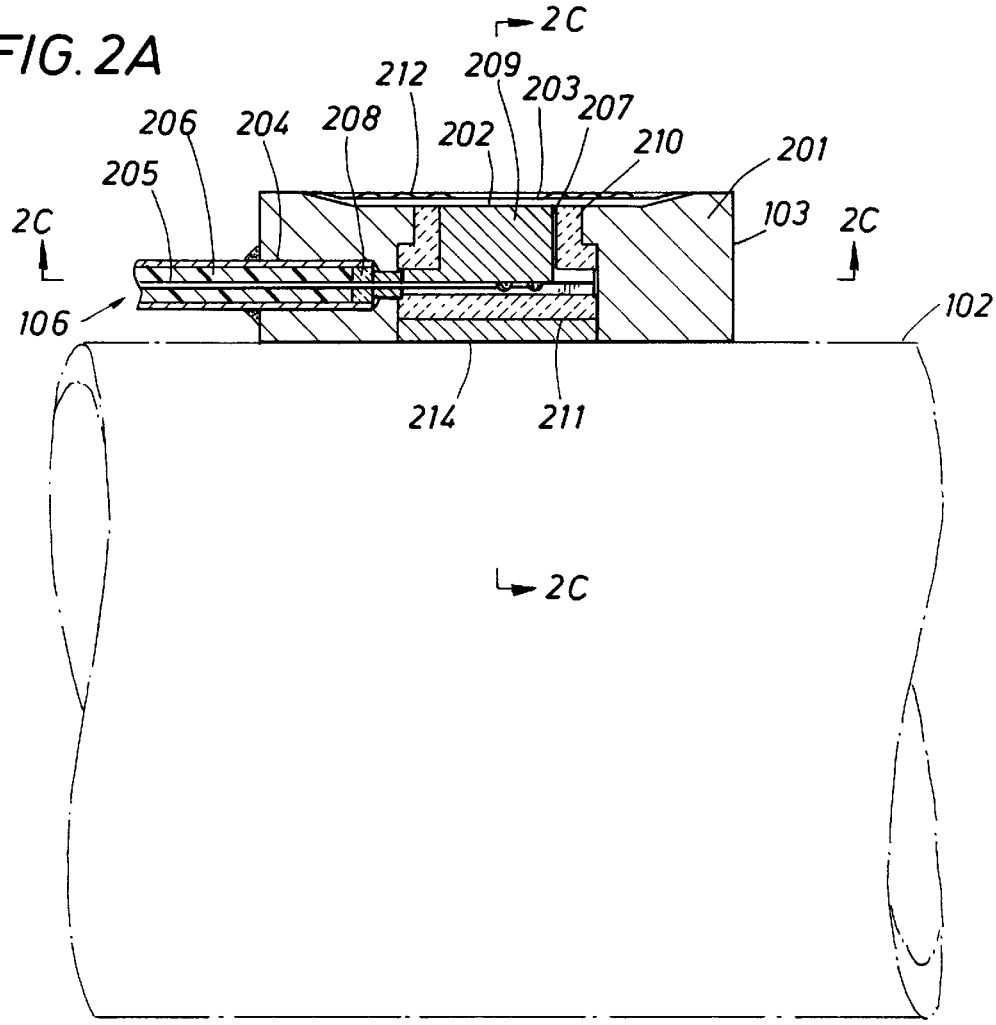
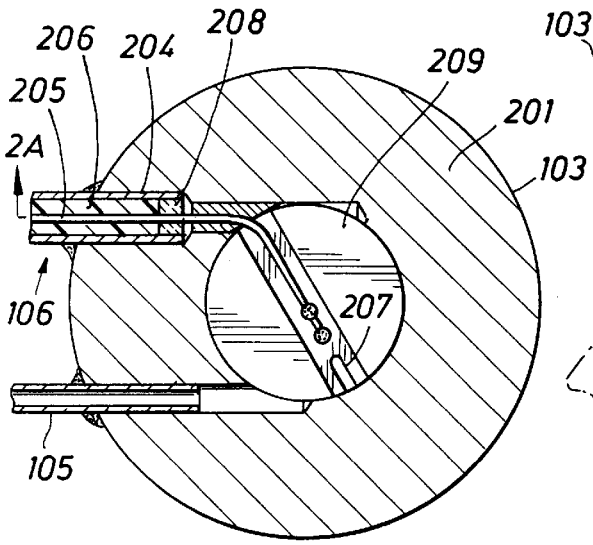
FIG. 2B
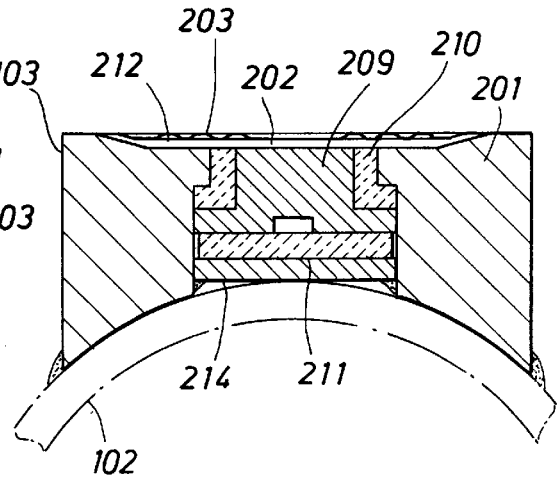
FIG. 2C

FIG. 3A
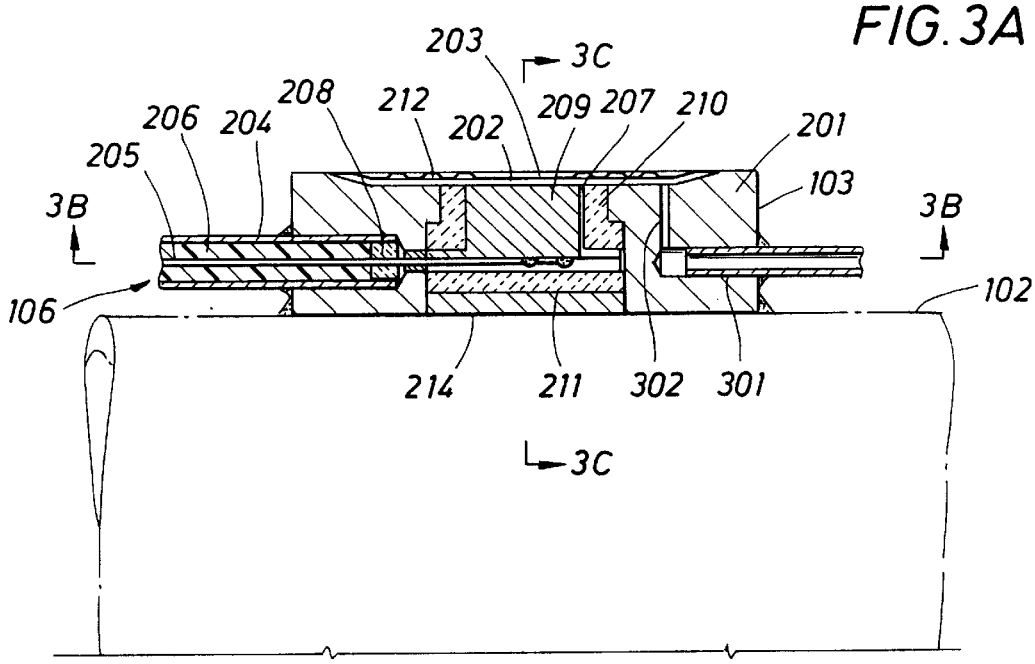
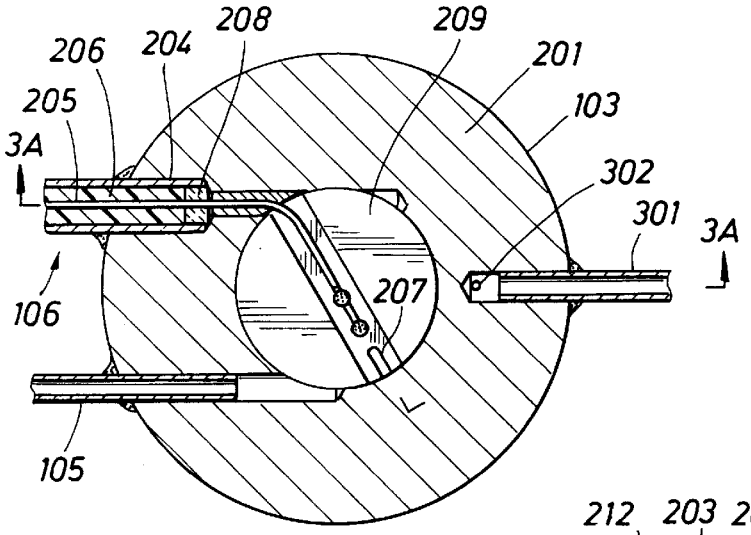
FIG. 3B
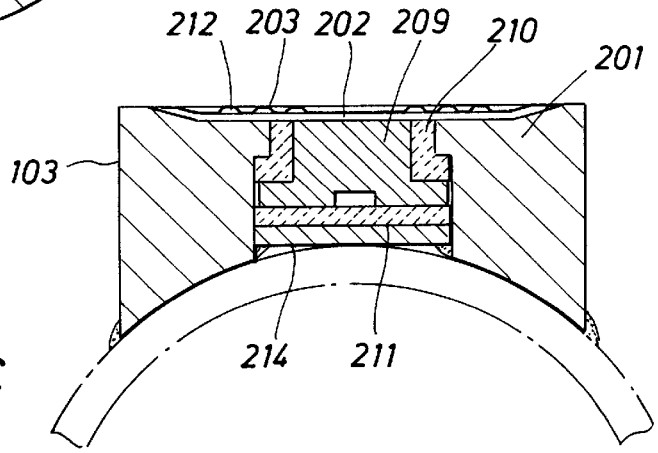
FIG. 3C

METHOD AND APPARATUS TO DETERMINE SUBTERRRANEAN FORMATION STRESS

RELATED APPLICATIONS

This application claims priority to U.S. patent application Ser. No. 60/049,292, filed on Jun. 11, 1997.

FIELD OF THE INVENTION

The present invention relates to a method to determine stress within a subterranean formation by measurement of pressure against a measurement device attached to a casing, and to the measurement device useful in this method.

BACKGROUND TO THE INVENTION

Stress as in subterranean formations are usually determined in order to design formation fracturing operations, but typically these stresses are determined empirically by applying pressure to the formation from a wellbore until a fracture initiates. Typically, formation stresses will not be important variables in design of wellbore tubulars because the tubular strength is dictated by the necessity of the tubular to support a significant length of itself. This is not the case when the wellbore is to be used as a heat injection well in a thermal recovery project. The casing will only have to support itself until it is cemented into place. This is done when the casing is relatively cool. When the heat injection well is placed in service, the casing will be heated to a temperature that is preferably between about 1400° F. and 2000° F. The thickness of the casing must be sufficiently thick so that, at these conditions, the casing will not buckle due to formation stress. This thickness is much greater than what is required to support a significant length of the casing.

Even if the initial formation stress is determined prior to beginning heating operation of a heat injection well, the initial stress may not be indicative of the stress over the entire cycle of the heating operation. The cost of the tubulars, and the casing in particular, are a major portion of the initial cost of the heat injection well, and therefore it would be desirable to know what the formation stresses on the casing are during the operation of the heat injection well. For example, the operating temperature of the well may be limited initially if the formation stress increases initially due to heating of the rocks, and then the operating temperatures might be increased later in the process if formation stresses decrease.

An obvious alternative to determine the stress a formation is placing on a casing would be to attach a strain gauge directly to the casing. This would be a simple and direct solution, but such a strain gauge would be subject to errors including a large zero-drift as the tubular is subject to creep during the life of the casing, and leakage of the signal over a long electrical leads to the surface. These errors would render the strain gauge application less than acceptable for long-term monitoring of formation stress.

Various methods are also available to measure the fluid pressure within a formation. These methods do not determine the total pressure on the casing, but only the fluid pressure.

Because there is presently no method available to determine actual formation stress during operation of a wellbore, it would be desirable to provide such a method. It is therefore an object of the present invention to provide a method to determine the stress within a formation during the operation of a wellbore.

SUMMARY OF THE INVENTION

These and other objectives are accomplished by a method to determine stress within a formation, the method comprising the steps of: providing a closed reference pressure volume within the formation; providing a flexible diaphragm which can be exposed on one side to formation, and on the other side to the closed reference pressure volume; providing a switch wherein the switch generates a signal based on the diaphragm being in a position indicative of the diaphragm being flexed by pressure on one side of the diaphragm being greater than pressure on the other side of the diaphragm; cycling a pressure within the reference pressure volume to between a pressure at which a signal is generated and a pressure at which a signal is not generated; and determining the formation stress as the pressure at which the signal changes.

The switch is preferably an electrical contact with a stationary contact surface on the closed reference pressure volume side of the diaphragm and a moving contact surface that moves with flexing movement of the diaphragm, the contacts being closed when the pressure on the formation side of the diaphragm is greater than the pressure on the reference pressure volume side of the diaphragm by a threshold amount, and the signal is grounding of an electrical potential applied to one of the two contacts. The pressure within the reference pressure volume is then varied between a pressure at which the contact is opened and a pressure at which the contact is closed.

Another aspect of the present invention is the apparatus useful in this method. This method and apparatus permit determination of stress within a formation with a reliable, simple, and inexpensive instrument.

The method and apparatus of the present invention is preferably applied in a heat injection wellbore application to enable operation near the limitation of buckle stress of the casing of the wellbore.

BRIEF DESCRIPTION OF THE FIGURES

FIGS. 2A, 2B and 2C are partial cross sectional views of a sensor for the apparatus of the present invention.

FIGS. 3A, 3B and 3C are partial cross sectional views of a sensor for the apparatus of the present invention.

DETAINED DESCRIPTION OF THE INVENTION

Figure 1:
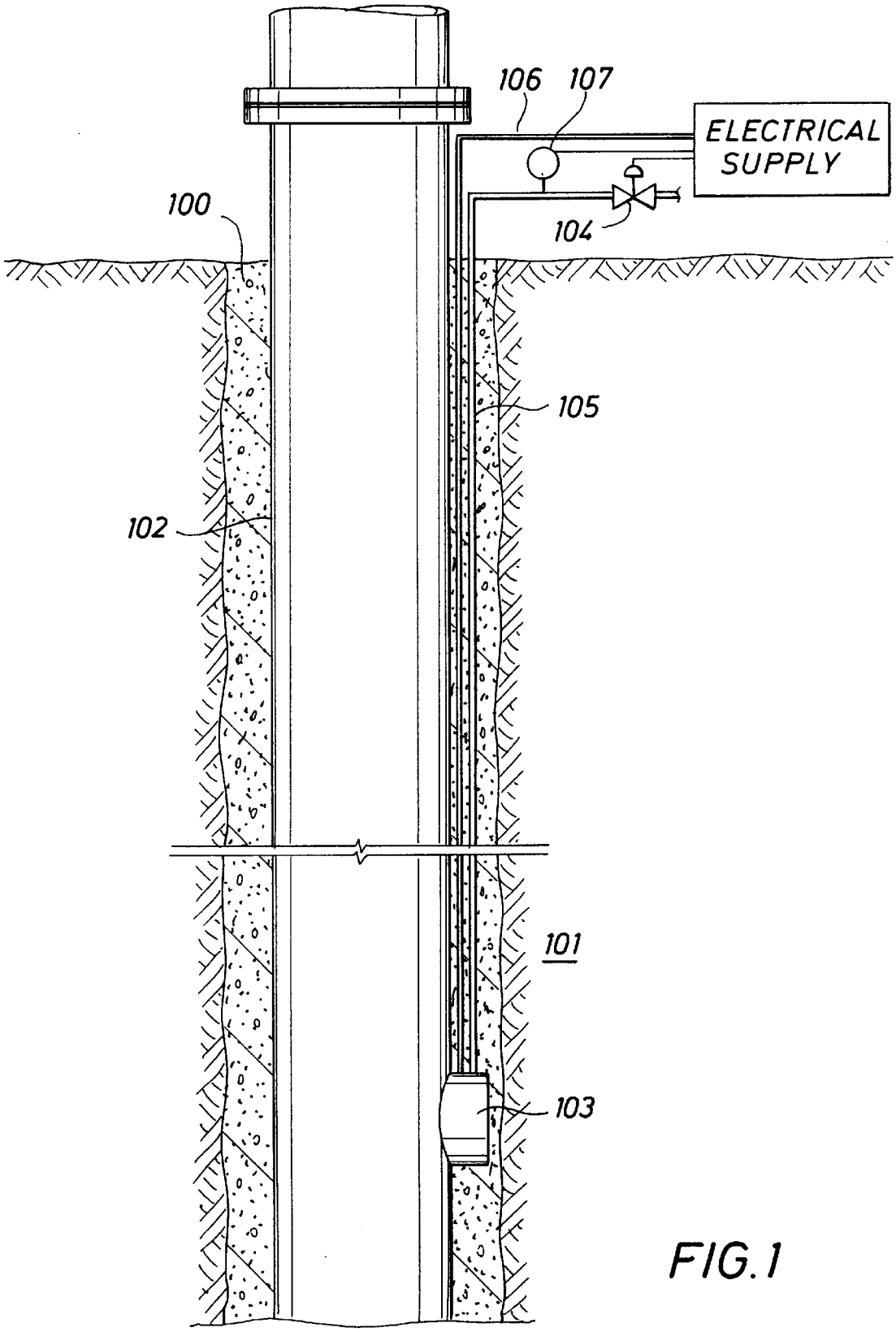
FIG. 1 is a schematic drawing showing the component of the apparatus of the present invention.

Referring now to FIG. 1, a wellbore 100 is shown, the wellbore penetrating a formation 101. A casing 102 is provided within the wellbore. A sensor 103 of the apparatus of the present invention is welded to the outside of the casing at a point within the formation of interest. Gas from a high pressure supply (not shown) is supplied through a control valve 104 and gas supply line 105. A pressure sensor 107 may be used to determine the pressure downstream of the control valve as a control pressure. An electrical lead 106, preferably connected to a low voltage electrical supply, extends from the surface to the sensor. The sensor will ground the electrical lead when the gas supply pressure is below the pressure exerted on the sensor, and will open the circuit when the pressure supplied to the sensor is above the pressure exerted by the formation on the sensor. Pressure of the gas supplied to the sensor is therefore cycled up and down by the control valve 104, with the stress determined as the pressure at which the electrical contact is broken (when the gas supply pressure is decreasing) or made (when the gas supply pressure is increasing).

Because formation stress varies depending on the radial direction with respect to the casing, the sensor is preferably orientated facing the maximum expected formation stress. Further, it is preferred that the diaphragm dimensions be such that the smallest distance across (diameter for a circular diaphragm) be a significant portion of the diameter of a casing on which stress is being measured. This ensures that the force measured is reflective of the pressure actually being exerted on the casing.

The gas pressure is preferably cycled to pressures that are within about 5 psi of the last determined formation stress, and cycled relatively slowly. The cycles are preferably of about one half minute to about 5 minutes in duration in order to ensure that the pressure measured near the surface is relatively close to the pressure existing within the sensor, and that the formation has relaxed to result in formation stress pressure resting on the diaphragm.

In a high temperature application of the present invention, such as a heat injection well, the metallurgy of the diaphragm must be carefully selected considering both the temperatures and the corrosion environment expected in the formation. For an environment where oxygen and hydrogen sulfide are expected, for example, 253 MA is preferred. The diaphragm is preferably of a thickness of between about four mils and about twenty mils.

Referring now to FIGS. 2A, 2B and 2C, (with elements numbered as in FIG. 1) a sensor useful in the present invention is shown. This sensor 103 is shown welded onto a casing 102. A body of the sensor 201, provides a formation-facing side 202, that may match the contour of a diaphragm 203. In a preferred embodiment of the present invention, the body behind the diaphragm is conical, and not ridged to match the diaphragm. When the body adjacent to the diaphragm matches the contour of the diaphragm, the diaphragm can be provided improved support when pressed against the body of the sensor, but it has been found that it is difficult to ensure proper alignment of the two surfaces, and if the two surfaces do not remain well aligned, the contours can prevent proper operation of the switch.

An electrical line 106 with a sheath 204, conductor 205 and insulation 206 provides electrical potential to the sensor. An annular ceramic plug 208 insulates and provides support for the conduit within the sensor. The conductor is welded to a contactor 209. The contactor is positioned so that when the diaphragm is relaxed (or pressure on each side of the diaphragm is about equal) the diaphragm is not in contact with the contactor, but when the pressure on the formation side of the diaphragm is slightly greater than the side of the diaphragm that faces the body of the sensor, the diaphragm is forced to contact the contactor. Because the diaphragm is in electrical contact with the body of the sensor, and the body of the sensor is welded to the casing, the diaphragm is electrically grounded.

A ceramic doughnut 210 provides electrical insulation between the contactor from the body of the sensor, and keeps the contactor centered. A metal plug 214 is welded into the back side of the sensor to seal the cavity in which the contactor sits. Ceramic disc 211 provides electrical insulation between the contactor and the plug.

The gas supply tubing 105 provides communication between a controllable source of high pressure gas (not shown) and the volume between the diaphragm and the body of the sensor (the reference pressure volume) 212. The path between the gas supply line and the volume between the diaphragm and the body of the sensor is shown as a gap 207 around the ceramic doughnut 210.

A significant feature of the sensor shown in this FIG (and in FIGS. 3A–3C) is the offset between the centerline of the electrical conduit lead and the center of the contactor. This offset provides enough flexibility to enable thermal expansion of the conductor without stress being placed on the weld connecting the conductor to the contactor. To permit this thermal expansion, the contactor and the ceramic doughnut are cylindrical, and allowed to rotate within the body of the sensor.

Referring now to FIGS. 3A, 3B and 3C, with elements numbered as in the previous figures, another embodiment of the present invention is shown. The improvement of this embodiment is provision of a return gas conduit 301. This conduit is in communication with a channel 302 that leads to the volume between the diaphragm and the body of the sensor. In this embodiment it is preferred that the contactor not extend significantly past the surface of the body of the sensor. Thus, when the diaphragm is pressed against the contactor, the gas supply is separated from the return gas conduit. The diaphragm acts as a valve and closes the flowpath. Thus a pressure or flow of gas at the surface from the return gas conduit can be used to determine if the diaphragm is pressed against the body of the sensor. The return gas flow or pressure can therefore be used as a back-up indication of the position of the diaphragm, or as the only means if the electrical signal is not utilized.

A return gas flow conduit could also provide a purge for the system, or a flow from which a sample can be withdrawn to determine if the sensor is leaking.

We claim:

1. A method to determine stress within a formation, the method comprising the steps of:

providing a closed reference pressure volume within the formation;

providing a flexible diaphragm which can be exposed on one side to the formation, and on the other side to the closed reference pressure volume;

providing a switch wherein the switch generates a signal based on the diaphragm being in a position indicative of the diaphragm being flexed by pressure on one side of the diaphragm being greater than pressure on the other side of the diaphragm;

cycling a pressure within the reference pressure volume to between a pressure at which a signal is generated and a pressure at which a signal is not generated; and determining the formation stress as the pressure at which the signal changes;

wherein the switch is an electrical contact with a stationary contact surface on the closed reference pressure volume side of the diaphragm and a moving contact surface that moves with flexing movement of the diaphragm, the contacts being closed when the pressure on the formation side of the diaphragm is greater than the pressure on the reference pressure volume side of the diaphragm by a threshold amount.

2. The method of claim 1 wherein the signal is grounding of an electrical potential applied to one of the two contacts.

3. The method of claim 1 wherein the pressure within the reference pressure volume is then varied between a pressure at which the contact is opened and a pressure at which the contact is closed.

4. The method of claim 3 wherein the pressure within the reference pressure volume is varied at a frequency of between about one half minute and about five minutes.

5. The method of claim 1 wherein the flexible diaphragm is placed essentially facing the direction from which the est stress from the formation is expected.

6. An apparatus suitable to determine stress within a formation comprising:

a closed reference pressure volume within the formation; a flexible diaphragm which can be exposed on one side to formation, and on the other side to the closed reference pressure volume;

a switch wherein the switch generates a signal based on the diaphragm being in a position indicative of the position of the diaphragm being flexed by pressure on one side of the diaphragm being greater than pressure on the other side of the diaphragm; and a means to cycle a pressure within the reference pressure volume to about the pressure required to generate the signal and a pressure at which the signal is not generated;

wherein the switch is an electrical contact with a stationary contact surface on the closed reference pressure volume side of the diaphragm and a moving contact surface that moves with flexing movement of the diaphragm, the contacts being closed when the pressure on the formation side of the diaphragm is greater than the pressure on the reference pressure volume side of the diaphragm by a threshold amount.

7. The apparatus of claim 6 wherein the signal is grounding of an electrical potential applied to one of the two contact.

8. The apparatus of claim 6 further comprising a means to vary the pressure within the reference pressure volume between a pressure at which the contact is opened and a pressure at which the contact is closed.

9. The apparatus of claim 6 further comprising a return gas conduit, the return gas conduit providing a flowpath for gas from the reference pressure volume to the surface.

10. The apparatus of claim 9 wherein the valve is a portion of the diaphragm which presses against an opening in a flow path connecting the gas supply and the return gas conduit.

11. The apparatus of claim 6 wherein the switch is a valve operated by movement of the diaphragm.

* * * * *